US012433355B2

(12) United States Patent
Benton

(10) Patent No.: US 12,433,355 B2
(45) Date of Patent: Oct. 7, 2025

(54) COMPLETE FACE SHIELD

(71) Applicant: Erica Benton, Fort Myers, FL (US)

(72) Inventor: Erica Benton, Fort Myers, FL (US)

( * ) Notice: Subject to any disclaimer, the term of this patent is extended or adjusted under 35 U.S.C. 154(b) by 127 days.

(21) Appl. No.: 17/485,502

(22) Filed: Sep. 27, 2021

(65) Prior Publication Data

US 2023/0102596 A1 Mar. 30, 2023

(51) Int. Cl.
*A41D 13/11* (2006.01)

(52) U.S. Cl.
CPC ..... *A41D 13/1184* (2013.01)

(58) Field of Classification Search
CPC ..... A41D 13/1184; A41D 13/1161; A41D 13/1107; A41D 13/11; A41D 2400/52; A61F 9/025; A61F 9/02; A61F 9/06; G02C 7/16; A42B 3/225; A42B 3/18
See application file for complete search history.

(56) References Cited

U.S. PATENT DOCUMENTS 3,686,690 A * 8/1972 Webb ..... A42B 3/225 2/9
5,206,956 A * 5/1993 Olson ..... G02C 7/16 128/857
5,765,223 A * 6/1998 McCausland ..... A41D 13/1184 2/427
5,983,390 A * 11/1999 Desy ..... A41D 13/1161 2/9
7,077,140 B1 7/2006 Berke
D555,785 S 11/2007 McAuley et al.
8,240,302 B1 8/2012 Tayebi et al.
8,261,375 B1 9/2012 Reaux
9,629,401 B2 4/2017 Al Malki
9,827,723 B2 11/2017 Klockseth
2005/0251890 A1* 11/2005 Landis ..... A41D 13/1184 2/9
2011/0067701 A1* 3/2011 Duffy ..... A41D 13/1115 128/206.19
2014/0261430 A1* 9/2014 Davis ..... A61M 16/06 128/205.25
2021/0298377 A1* 9/2021 Baker ..... A41D 13/1146
2021/0368879 A1* 12/2021 Motadel ..... A41D 13/1161
2022/0007761 A1* 1/2022 Hooley ..... H05F 1/02
2022/0030978 A1* 2/2022 Randlett ..... A41D 13/1161

FOREIGN PATENT DOCUMENTS

AT 16787 U2 * 6/2020 ..... A42B 3/225
WO WO-2010021606 A1 * 2/2010 ..... A41D 13/1184

* cited by examiner

*Primary Examiner* — Alireza Nia
*Assistant Examiner* — Mixhael Milo
(74) *Attorney, Agent, or Firm* — Gugliotta & Gugliotta LPA

(57) ABSTRACT

An illustrated view of an exemplary Complete Face Shield (or CFS 100) device for protecting people from spreading infectious diseases is presented. The CFS-100 device is useful for covering the complete face area of a person. The CFS-100 device is developed to protect a person from microscopic virus and/or bacteria in the air, is presented. The CFS-100 device is useful for providing an impervious protective layer for an entirety of a face of a person. The CFS-100 device is useful for preventing droplets in the air from contacting eyes, nose, ears, and mouth area of the person wearing this CFS-100 device and offers protection against contaminating other persons. Furthermore, the CFS-100 device provides an enhanced level of protection compared to typical face masks/shields/coverings that are available currently.

9 Claims, 2 Drawing Sheets

COMPLETE FACE SHIELD

FIELD OF THE INVENTION

This invention relates to face shields. More particularly, it relates an improvement to a face shield.

BACKGROUND

The ongoing COVID-19 pandemic was confirmed to have reached the United States in January 2020. The first confirmed case of local transmission was recorded in January, while the first known deaths happened in February. By the end of March, cases had occurred in all 50 U.S. states, the District of Columbia, and all inhabited U.S. territories except American Samoa. As of Jun. 24, 2020, the U.S. had the most confirmed active cases and deaths in the world. As of Jul. 16, 2020, its death rate was 419 per million people, the seventh-highest rate globally.

The Center for Disease Control (CDC) has issued a recommendation to the US population for prevention of contracting COVID 19 as well as other infectious diseases. Those recommendations are: 1) wash hands often; 2) avoid close contact (social distancing); 3) cover mouth and nose with a face covering when around others; 4) cover cough or sneezes; 5) dean and disinfect; and 6) monitor your health daily.

A face shield, an item of personal protective equipment (PPE), aims to protect the wearer's entire face (or part of it) from hazards such as flying objects and road debris, chemical splashes (in laboratories or in industry), or potentially infectious materials in medical and laboratory environments). With the recent CDC guidelines for COVID-19 pandemic, many have turned to shields that cover at least a part of their face, in particular their eyes, nose and mouth.

Recent events in our history remind us how susceptible humans are to contaminants in the air we breathe. Whether such contaminants are incidental such as dust, dirt, allergens or the like, or something more dangerous such as bacteria and viruses, many people turn to the use of scarves, masks or respirators for protection. While each of these offer varying levels of protection, face masks do not cover the entirety of a person's face, this can cause contact with one's eyes; droplets that land near the eyes, nose or mouth remain possible sources of infection. The current face masks/shields cover a portion, but not all, of a person's face which allows for the infectant to pose a danger to the person.

Accordingly, and in light of the foregoing, there exists a need for a device in which eyes, nose, ears, and mouth can be protected from direct contact against microscopic infectious droplets over the entirety of a person's face. Per ID, Infectious Disease practice, and ENT, Ear, Nose, and Throat Specialists, a respiratory disease/disorder is brought about due to contaminant exposure to one's eyes, nose, mouth, and ears. Covid-19 is a respiratory contaminant. The development of the Complete Face Shield with a removable and portable design, fulfills this need.

DETAILED DESCRIPTION

Figure 1:
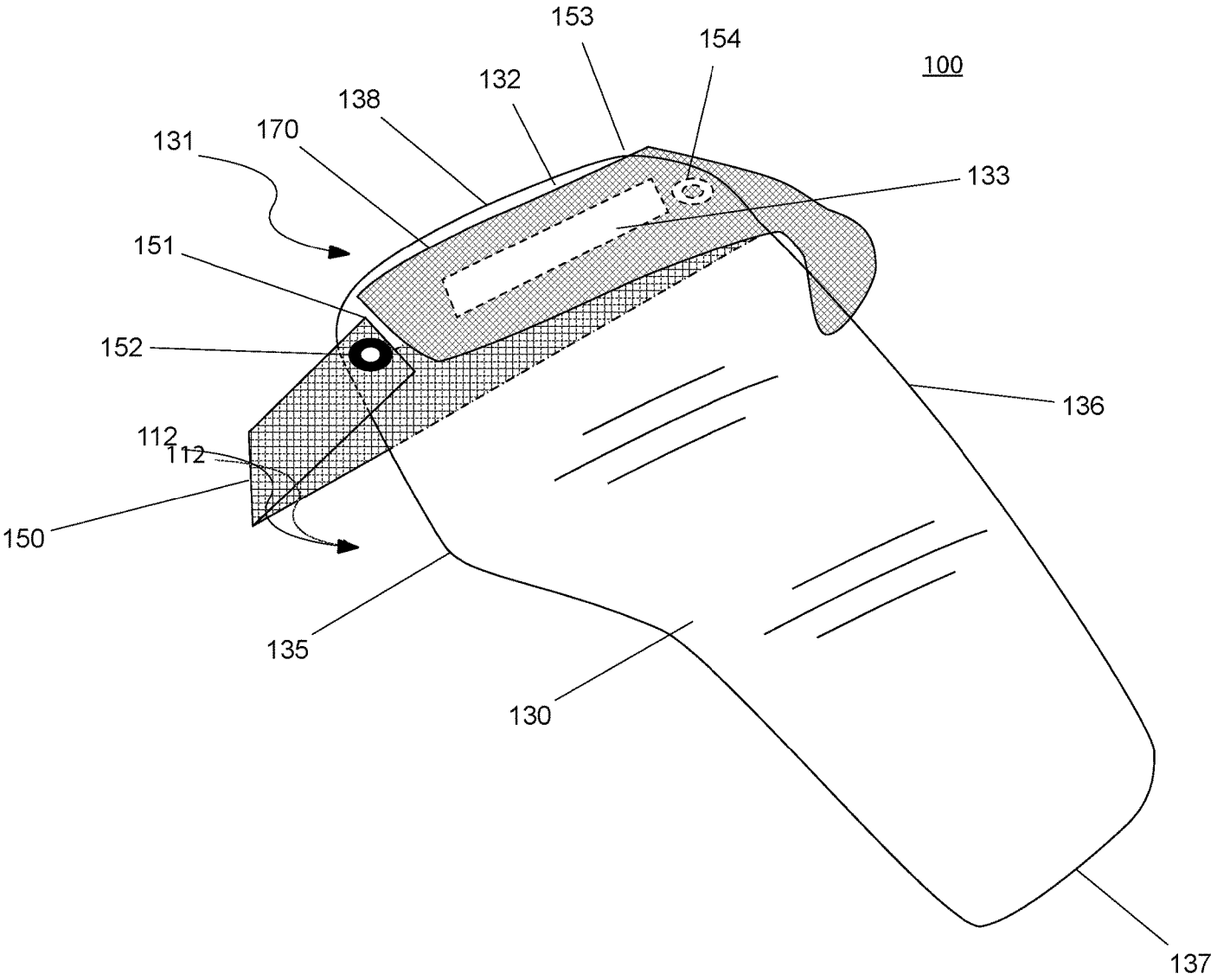
FIG. 1 is an illustrated view of an exemplary complete face shield device.

The phrases "in one embodiment," "in various embodiments," "in some embodiments," and the like are used repeatedly. Such phrases do not necessarily refer to the same embodiment. The terms "comprising," "having," and "including" are synonymous, unless the context dictates otherwise. Such terms do not generally signify a closed list.

"Above," "adhesive," "affixing," "any," "around," "both," "bottom," "by," "comprising," "consistent," "customized," "enclosing," "friction," "in," "labeled," "lower," "magnetic," "marked," "new," "nominal," "not," "of," "other," "outside," "outwardly," "particular," "permanently," "preventing," "raised," "respectively," "reversibly," "round," "square," "substantial," "supporting," "surrounded," "surrounding," "threaded," "to," "top," "using," "wherein," "with," or other such descriptors herein are used in their normal yes-or-no sense, not as terms of degree, unless context dictates otherwise.

Reference is now made in detail to the description of the embodiments as illustrated in the drawings. While embodiments are described in connection with the drawings and related descriptions, there is no intent to limit the scope to the embodiments disclosed herein. On the contrary, the intent is to cover all alternatives, modifications and equivalents. In alternate embodiments, additional devices, or combinations of illustrated devices, may be added to, or combined, without limiting the scope to the embodiments disclosed herein.

Referring to FIG. 1, an illustrated view of an exemplary Complete Face Shield device 100 (CFS-100) for protecting people from spreading infectious diseases is presented. The CFS-100 is useful for covering a complete face area of a person. The complete face shield device 100 protects a person from microscopic virus and/or bacteria in the air that may be present. The CFS-100 is useful for providing an impervious protective layer for an entirety of a person's face. The CFS-100 is useful for preventing droplets/particles in the air from contacting eyes, nose, mouth, and ears areas of the person. Furthermore, the CFS-100 provides an enhanced level of protection compared to typical face masks or currently available face shields in the market today.

The Complete Face Shield device 100 has a panel 130, a head band 150 and a forehead protector 170.

The panel 130 is preferably made of a clear plastic material, such as polyethylene terephthalate (PET), however other materials are hereby contemplated, including, but not limited to, clear poly-vinyl chloride (PVC), polypropylene, etc. The panel 130 is preferably manufactured using an injection or blow molding process, however other methods of manufacturing are further contemplated by this application. The panel 130 of the Complete Face Shield device 100 is preferably twelve (12) inches in width, however other widths are hereby contemplated, including, but not limited to, ten inches (10"), fifteen inches (15"), etc. The panel 130 of the complete face shield device 100 is preferably sixteen (16) inches in length, however other lengths are hereby contemplated, including, but not limited to, twelve inches (12"), nineteen inches (19"), etc. The panel 130 is preferably such a chosen width as to extend over a first ear (see FIG. 2) and a second ear (see FIG. 2) of a person. The panel 130 is preferably a chosen length as to extend from a top of the person's head (see FIG. 2) to below a the chin line to mid-neck of the person (see FIG. 2).

The head band 150 is preferably made of a braided elastic material, however other types of materials are hereby contemplated, including, but not limited to, knitted elastic, woven elastic, etc. The head band 150 is preferably extendable and/or retractable to fit snuggly to a person's head.

The forehead protector 170 is preferably made of a foam material, however other types of material are hereby contemplated, including, but not limited to, soft rubber, air-filled balloons, etc. The forehead protector 170 has a width being less than the width of the panel 130.

The panel 130 has a first side 135, a second side 136, a first end 137 and a second end 138. A first end 151 of the head band 150 is coupled to the second end 138 of the panel 130 by a first coupling device 152. A second end 153 of the head band 150 is coupled to the second end 138 of the panel 130 by a second coupling device 154. The first coupling device 152 is preferably by a plastic fastener, however other types of coupling devices are hereby contemplated, including, but not limited to, a clasp, an adhesive material, etc. The second coupling device 154 is preferably by a plastic fastener, however other types of coupling devices are hereby contemplated, including, but not limited to, a clasp, an adhesive material, etc. The first coupling device 152 is preferably the same type of coupling device as the second coupling device 154, however it is hereby contemplated that the first coupling device 152 may be a different type of coupling device as the second coupling device 154.

The forehead protector 170 is coupled to an inside 131 of a top 132 of the panel 130 by a coupling agent 133. The coupling agent 133 is preferably a snap fastener, however other coupling agents are hereby contemplated, including, but not limited to, adhesive, two-sided tape, mechanical fasteners, etc.

Figure 2:
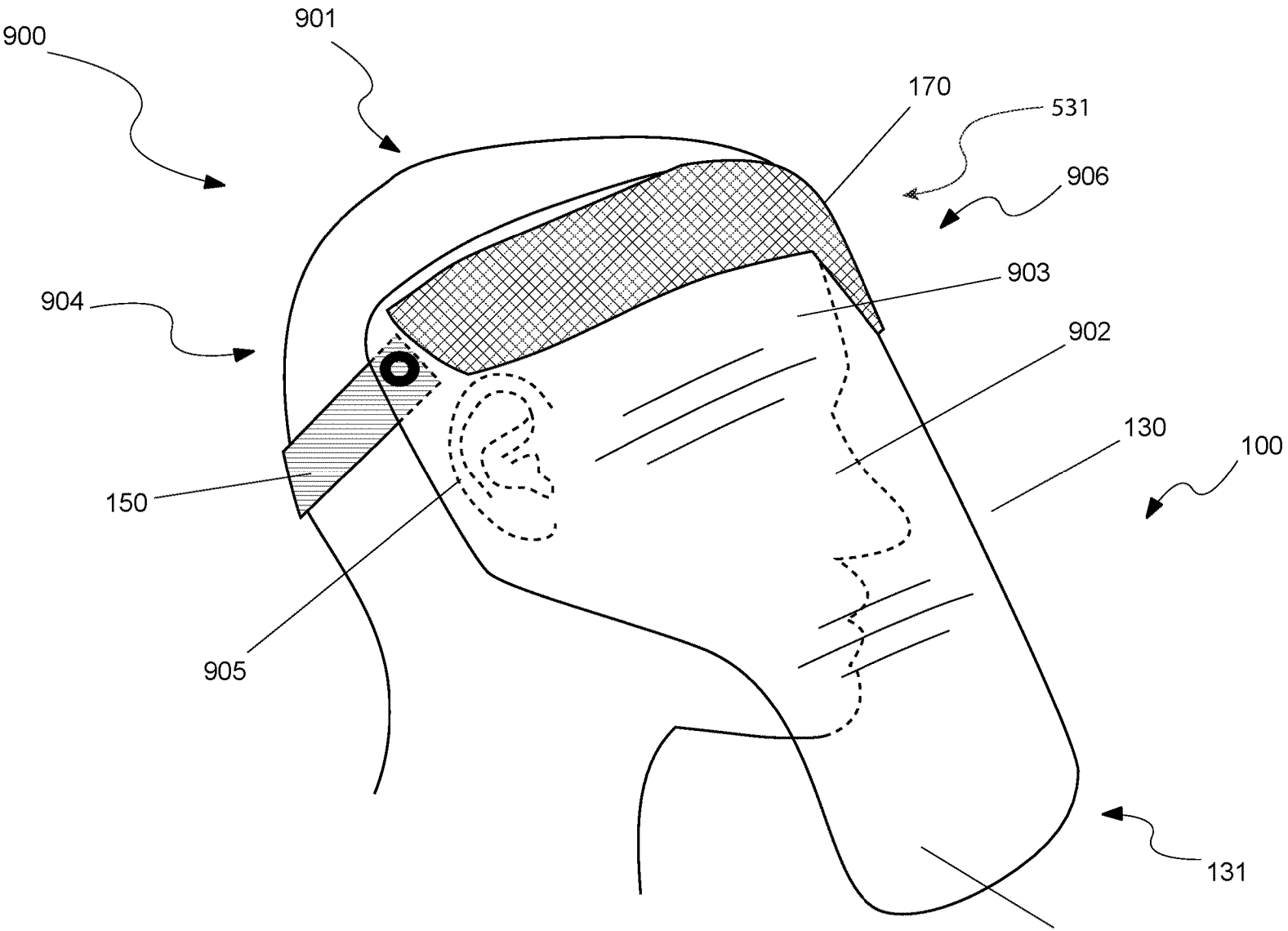
FIG. 2 is an illustrated use of the complete face shield device shown in FIG. 1.

Referring to FIG. 2, an illustrated use of the complete face shield device 100 shown in FIG. 1 is presented.

A person 900 is presented such that the following detailed description can describe the Complete Face Shield device 100 in reference to the person 900. The person 900 has a head 901. The head 901 has a face 902, a forehead 903, a back of the head 904, a first ear 905, a second ear 906 and a chin-line 909.

The panel 130 of the Complete Face Shield 100 is placed over the face 902 of the head 901 of the person 900. The head band 150 is placed around the head 901 such that the head band 150 is securely and removably coupled from the back 904 of the head 901. The forehead protector 170 coupled to the inside 131 of the panel 130 is securely in contact with the forehead 903 of the head 901 of the person 900. The Complete Face Shield device 100 is configured to cover over the first ear 905 and over the second ear 906. The complete face shield device 100 is further configured to cover from the entirety of the face 902 from the forehead 903 to below the chin line at mid-neck 909 in a customizable length from the head 901 of the person 900.

In the numbered clauses below, specific combinations of aspects and embodiments are articulated in a shorthand form such that (1) according to respective embodiments, for each instance in which a "component" or other such identifiers appear to be introduced (with "a" or "an," e.g.) more than once in a given chain of clauses, such designations may either identify the same entity or distinct entities; and (2) what might be called "dependent" clauses below may or may not incorporate, in respective embodiments, the features of "independent" clauses to which they refer or other features described above.

Those skilled in the art will appreciate that the foregoing specific exemplary processes and/or devices and/or technologies are representative of more general processes and/or devices and/or technologies taught elsewhere herein, such as in the claims filed herewith and/or elsewhere in the present application.

The features described with respect to one embodiment may be applied to other embodiments or combined with or interchanged with the features of other embodiments, as appropriate, without departing from the scope of the present invention.

Other embodiments of the invention will be apparent to those skilled in the art from consideration of the specification and practice of the invention disclosed herein. It is intended that the specification and examples be considered as exemplary only, with a true scope and spirit of the invention being indicated by the following claims.

What is claimed is:

1. A complete face shield device comprising:

a transparent panel configured to extend over a first ear and a second ear of a user and configured from a top of a user's head to below a user's chin;

wherein a height of the transparent panel consists of exactly 16 inches and a width at a section of the transparent panel consists of exactly 12 inches configured to provide complete coverage of a user's face including the first ear and the second ear while maintaining forward visibility;

wherein the transparent panel is formed of clear polyvinyl chloride (PVC) or polypropylene material with a material thickness;

wherein the transparent panel includes curved side portions that are configured to wrap around the wearer's head at an angle relative to a frontal plane, wherein the curved side portions have a concavity below ear level, and wherein the transparent panel does not include any fastening elements positioned directly in front of the wearer's ears;

wherein the transparent panel tapers inward a flexible head band coupled to the transparent panel near a top portion of the transparent panel, wherein the forehead protector is configured to create a seal against a user's forehead to prevent entry of airborne contaminants; and wherein the forehead protector is formed of soft rubber or air-filled material or a foam layer to provide comfort to the user's forehead and comprises a width, which is less than the width of the transparent panel.

2. The complete face shield device of claim 1, wherein the transparent panel provides is configured to provide an impervious protective layer for an entirety of the user's face.

3. The complete face shield device of claim 1, wherein the transparent panel includes a curved configuration with a first side and a second side, and wherein the transparent panel is configured to extend laterally beyond the user's ear to cover and protect the first ear and the second ear from airborne contaminants.

4. The complete face shield device of claim 1, wherein the transparent panel consists of a length of sixteen inches, extending from a top of the user's head to below the user's chin.

5. The complete face shield device of claim 1, wherein the flexible head band is formed of knitted elastic or woven elastic material.

6. The complete face shield device of claim 1, wherein the flexible head band includes a first coupling device on a first side of the transparent panel, the first coupling device comprising a plastic snap fastener.

7. The complete face shield device of claim 1, wherein the flexible head band includes a second coupling device on a second side of the transparent panel, the second coupling device comprising a plastic snap fastener.

8. The complete face shield device of claim 1, wherein the fastening elements are positioned above ear level and are not present in regions adjacent to the user's chin or mouth or in front of the user's ear when worn.

9. A complete face shield device consisting of:

a transparent panel with a material thickness, the transparent panel having a first end, a second end, a first side, a second side and an inside, wherein the transparent panel:

is formed of clear poly-vinyl chloride (PVC) or polypropylene material has a width at a section of the transparent panel of exactly twelve (12) inches;

has a height of exactly sixteen (16) inches;

is configured to extend laterally beyond a wearer's ears to fully enclose and protect the ears, wherein the transparent panel wraps around the sides of the face in a non-uniform curvature that changes from top to bottom of the transparent panel;

extends vertically from above a wearer's forehead to below a wearer's chin;

includes curved side portions that taper inward includes a concave portion below ear level on each side;

wherein the transparent panel does not include any fastening elements positioned directly in front of the wearer's ears or chin;

a flexible head band consisting of a braided elastic material that is extendable and retractable configured to snugly fit the user's head, the head band having:

a first end coupled to the first side of the transparent panel near the second end above ear level;

a second end coupled to the second side of the transparent panel near the second end above ear level;

wherein the coupling points of the head band to the transparent panel are positioned above the ear level when worn, and not connected at any point below ear level; and a forehead protector coupled to the inside of the transparent panel near a top of the second end of the transparent panel by a fastener, the forehead protector:

consisting of a foam layer or soft rubber material;

having a width, which is less than the width of the transparent panel;

configured to create a seal against the user's forehead to prevent entry of airborne contaminants from above.

* * * * *